US006030487A

United States Patent [19]

Fisher, Jr. et al.

[11] Patent Number: 6,030,487

[45] Date of Patent: Feb. 29, 2000

[54] WAFER CARRIER ASSEMBLY

[75] Inventors: Thomas R. Fisher, Jr., Beacon; Carol E. Gustafson, Poughkeepsie; Michael F. Lofaro, Milton, all of N.Y.

[73] Assignee: International Business Machines Corporation, Armonk, N.Y.

[21] Appl. No.: 08/878,567

[22] Filed: Jun. 19, 1997

[51] Int. Cl.[7] ..... B24B 1/00

[52] U.S. Cl. ..... 156/345; 451/444

[58] Field of Search ..... 156/345; 451/66, 451/282–289, 443, 444, 56; 216/88–90; 438/690–694

[56] References Cited

U.S. PATENT DOCUMENTS

| | | | |
|---|---|---|---|
| 4,098,031 | 7/1978 | Hartman et al. . | |
| 4,141,180 | 2/1979 | Gill, Jr. et al. . | |
| 4,490,948 | 1/1985 | Hanstein et al. . | |
| 4,850,157 | 7/1989 | Holmstrand . | |
| 4,910,155 | 3/1990 | Cote et al. . | |
| 4,954,142 | 9/1990 | Carr et al. . | |
| 5,216,843 | 6/1993 | Breivogel et al. . | |
| 5,456,627 | 10/1995 | Jackson et al. . | |
| 5,554,064 | 9/1996 | Breivogel et al. . | |
| 5,575,706 | 11/1996 | Tsia et al. | 451/41 |
| 5,650,039 | 7/1997 | Homayom Talieh | 216/89 |
| 5,707,274 | 1/1998 | Kim et al. | 451/285 |

*Primary Examiner*—R. Bruce Breneman
*Assistant Examiner*—Sylvia R. MacArthur
*Attorney, Agent, or Firm*—Whitham, Curtis & Whitham; Alison D. Mortinger

[57] ABSTRACT

A wafer carrier assembly including a subassembly for in-situ nondestructive pad conditioning, characterized by continuously cleansing the pad surface with an energized fluid. The fluid may be abrasive in nature, such as a slurry, or non-abrasive, such as DeIonized (DI) water. In addition, the fluid may be of a type known to assist in removing slurry and/or residual materials from a pad surface and followed by a DI water rinse. The chemical may be either liquid or gas.

20 Claims, 4 Drawing Sheets

WAFER CARRIER ASSEMBLY

RELATED APPLICATION

The present invention is related to U.S. patent application Ser. No. 08/878568 entilted "A Wafer Carrier for Chemical Mechanical Polishing" to Feeney, filed coincident herewith and assigned to the assignee of the present application. This application is pending.

BACKGROUND OF THE INVENTION

1. Field of the Invention

The present invention is related to semiconductor chip manufacture aparati and, more particularly, to reconditioning Chemical Mechanical Polishing pads used in semiconductor manufacturing and methods thereof.

2. Background Description

Current Chemical-Mechanical (Chem-Mech) Polish (CMP) processes utilize a variety of polishing pads. Typically, these pads are of a urethane material and characterized as either soft or hard. A hard pad provides an optimum planar surface. However, during processing, hard pads have a tendency to glaze over with residuals and waste slurry. This glazing degrades pad life and polishing results.

To overcome this glazing, state of the art polishers include a conditioner mechanism and/or a high pressure rinse bar. Typically, the conditioner is a large (9") diamond-dust-plated disk. After polishing a wafer, the conditioning disk is rotated in a fixed position on the pad in order to abrade and remove the glaze from the pad. If a rinse bar is used, it is fixed to the surface of the tool and extends out over the pad to the center of the platen to provide a fanned spray of deionized (DI) water to the pad. The rinse bar is used with the conditioner, between polish cycles, to rinse off debris from conditioning from the pad, prior to the next polish cycle.

Conventional conditioning equipment is rarely used during the polish cycle. Also, since it is separate from the carrier, there is an inherent lag time between pad conditioning or rinsing the resuming polishing. This time lag allows airborne contaminants to recontaminate the pad before it polishes the wafer.

SUMMARY OF THE INVENTION

It is a purpose of the invention to reduce pad surface contamination during the polish cycle.

It is another purpose of the present invention to provide an in-situ nondestructive conditioner with integrated rinse and slurry delivery capabilities.

It is yet another purpose of the present invention to provide an independent sub-environment for a wafer during processing so as to isolate the actual wafer-pad interface from the overall tool environment.

The present invention is a wafer carrier assembly including a subassembly for in-situ nondestructive pad conditioning, characterized by continuously cleansing the pad surface with an energized fluid. The fluid may be abrasive in nature, such as a slurry, or non-abrasive, such as DI water. In addition, the fluid may be of a type known to assist in removing slurry and/or residual materials from a pad surface and followed by a DI water rinse. The chemical may be either liquid or gas.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
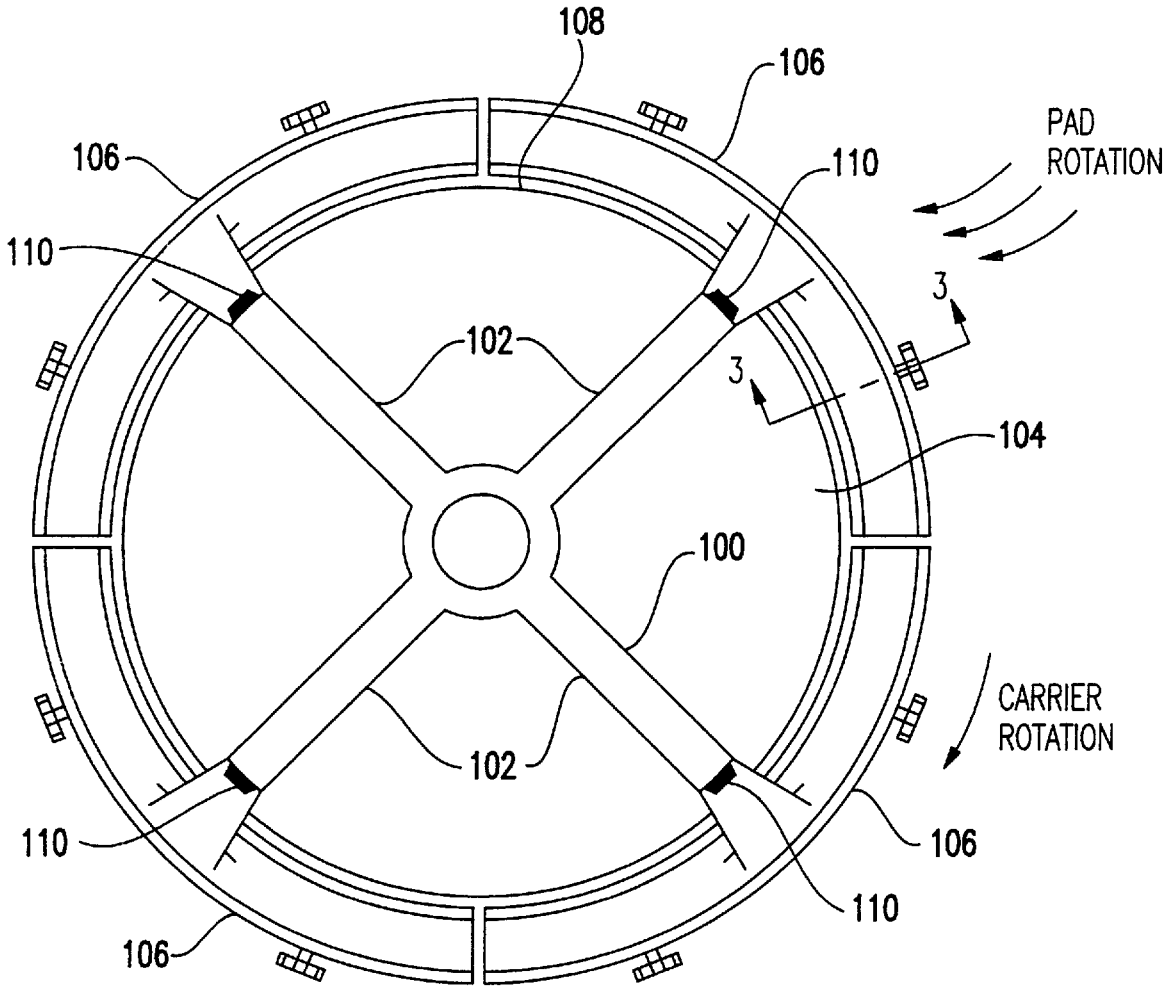
FIG. 1 is a top view of a preferred embodiment carrier assembly.

FIG. 1 is a top view of a preferred embodiment carrier assembly. A metallic Spider 100 with four legs 102 of stainless steel is attached to and extends from the center of the carrier 104 to the outer circumference 108 of a carrier 104. Preferably, the carrier is for a Westech IPEC wafer polisher, although the present invention may be adapted for use with any carrier in any polishing system. FIG. 1 also shows a hinge 110 and a skirt 106 as further described below.

Figure 2:
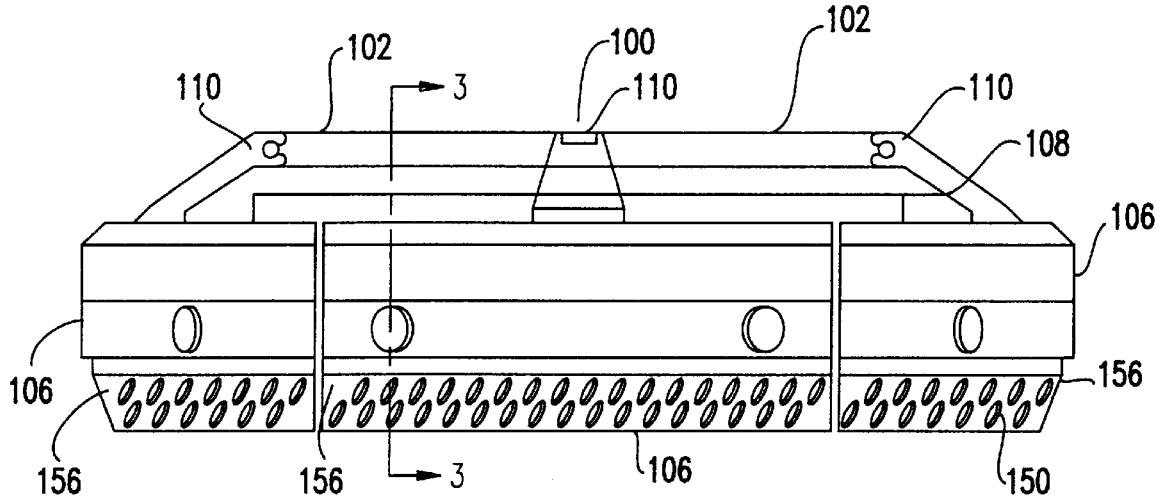
FIG. 2 is a side view of the assembly of FIG. 1.

FIG. 2 is a side view of the assembly of FIG. 1. Each Spider leg 102 is hinged at one end and joined to the center of the carrier 104 (see also FIG. 1). A cleaning attachment section ("skirt") 106 is connected to each leg 102 at its hinge 110. Each leg 102 may be channel shaped for securing and passing lines of appropriate material such as DI water or slurry to the attached skirt section 106. Each leg 102 also includes wiring for passing electrical connections to the skirt section 106. The hinge 110 allows drawing the skirt sections 106 rotationally up and away from the carrier circumference for carrier changes or maintenance. The carrier skirt 106 is independent of the carrier 104. FIG. 2 also shows pad cleaning outlets 150 in the skirt 106, and further shows a beveled surface 156 about the skirt 106.

Figure 3:
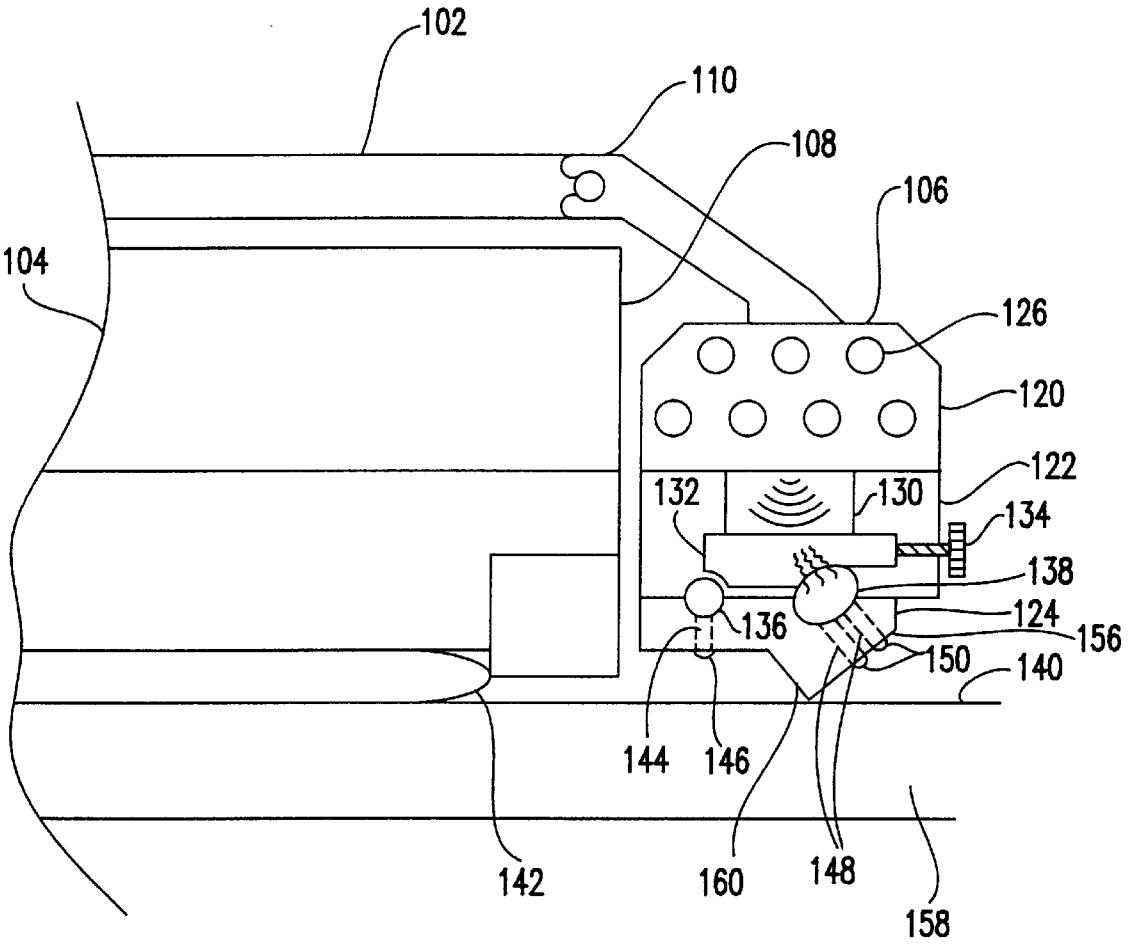
FIG. 3 is a cross-section of the assembly of FIG. 1 through 3—3.
Figure 4:
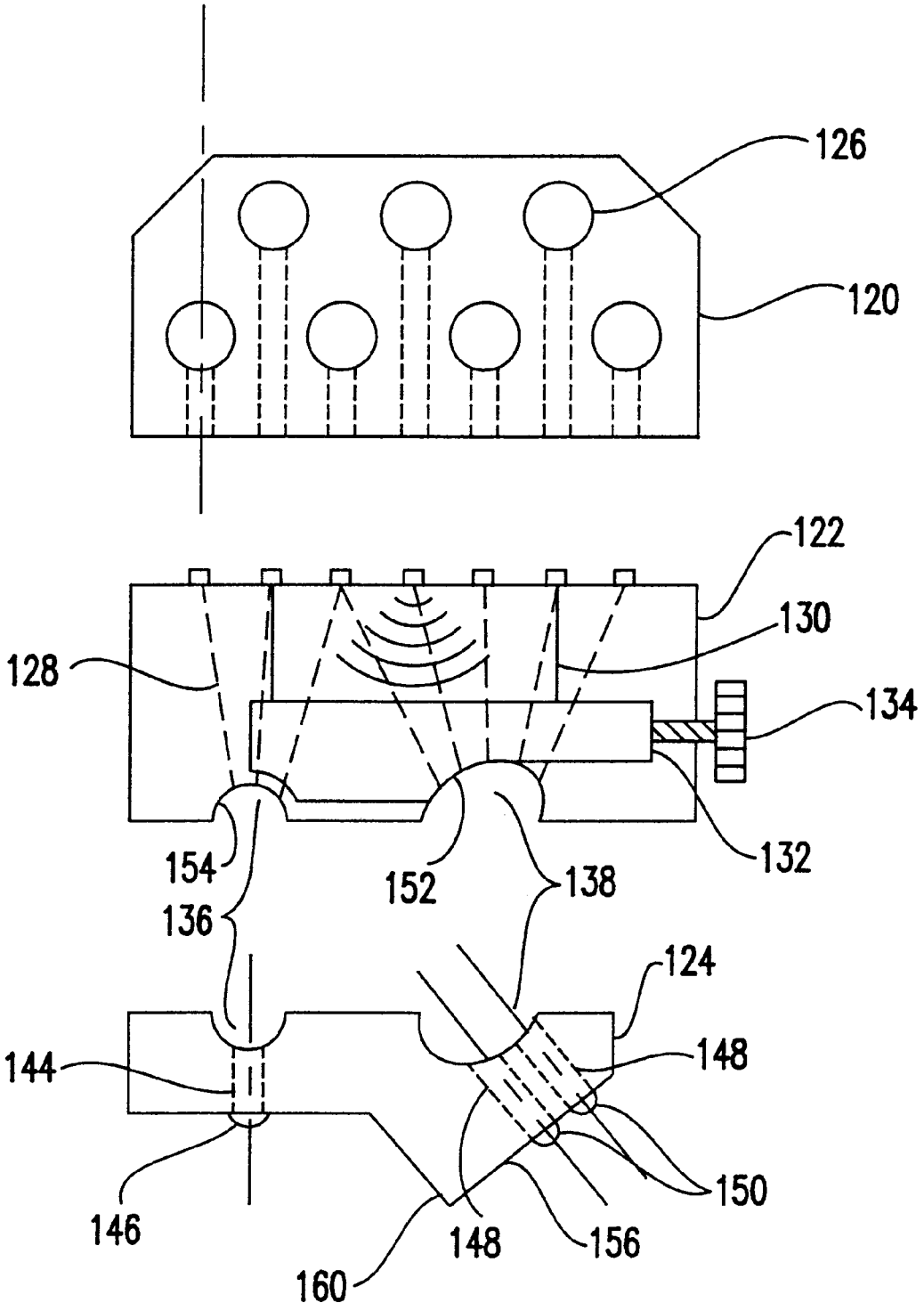
FIG. 4 is an exploded view or the cross section of the preferred embodiment skirt in FIG. 3.

FIG. 3 is a cross-section of the assembly of FIG. 1 through 3—3. FIG. 4 is an exploded view or the cross section of the preferred embodiment skirt in FIG. 3. Preferably, each skirt section 106 is a three-piece assembly, to allow disassembly for cleaning, for replacement of transducers or any other form of required maintenance. Optionally, the skirt may be a single piece. However, the preferred embodiment three-piece skirt 106 assembly includes a top distribution section 120, a mid-section 122 and a bottom fluid delivery section 124.

The hinge 110 is connected to the top, distribution section 120 of the assembly 106 to connect the skirt 106 to Spider legs 102. Fluids are distributed from the Spider legs 102 via a series of circumferential fluid lines 126 plumbed in the distribution section 120. Preferably, the number of fluid lines 126 is seven; however, more or less fluid lines 126 may be provided, and different fluid distribution can accommodate passing different fluids to the delivery section 124.

The mid section 122 contains vertical lines or vias 128 (top to bottom), ultrasonic or megasonic transducers 130 and a acoustic switching mechanism (rail 132 and positioning screws 134). The vias 128 pass fluid from the upper fluid distribution section 120 to the fluid delivery section 124. Preferably, the number of vias 128 is the same as the number of fluid distribution lines 126.

The transducers 130 are seated in preformed sockets in the top of the mid section 122. This allows easy access for removing and replacing the transducers 130 when the skirt 106 is disassembled. The active area of each transducer 130 faces down, towards the delivery section 124. Thus, active transducer area contacts a slide rail 132 of acoustic coupling material. Acoustic energy passes through the slide rail 132, transmitting energy from the transducers 130 into fluid in contact with the rail 132.

Megasonic cleaning is well known in the semiconductor manufacturing art. The preferred embodiment assembly uses ultrasonic or megasonnic energy for in-situ pad cleaning in CMP process. Using megasonic energy to energize the slurry flow during processing reduces normal surface scratching otherwise caused by agglomerated slurry particles during the polish process. This energy prevents the agglomeration of particles in slurry, providing an improved polish. Therefore, it is necessary for the transducer to continuously feed conditioning energy to the pad cleaning fluid for optimum pad conditioning.

The megasonic energy may also be used selectively to energize slurry or rinsing fluid. The rail 132 is movable. Thumbscrew 134 drives the rail 132 radially in or out to switch on or off the megasonic energy to the slurry or rinsing fluid. This is described in more detail hereinbelow.

The delivery section 124 mates with the mid section 122 forming distribution channels 136, 138 for delivering fluids to the pad surface 140. The inner channel 136 delivers slurry to the wafer 142 during the polish cycle or a rinse fluid (for example, DI water) following the polish cycle. Vias 144 from the inner channel 136 deliver fluid through outlets 146 that may be tubular or slit for a fanned spray type delivery.

The outer channel 138 is plumbed with a dual array of vias 148 to deliver fluid through overlapping pad cleaning outlets 150 that may be either slit for a fanned spray, or fitted with adjustable nozzles (not shown) for variable fluid delivery to the pad surface 140. These slits or nozzles in pad cleaning outlets 150 provide in-situ nondestructive conditioning of the pad surface 140.

The distribution channels 136, 138 are located such that the rail 132 is always part of the upper wall 152 of the outermost distribution channel 138. Megasonic energy conducted to the outer channel 138 by the rail 132, continuously energizes the pad cleaning fluid flowing through the channel 138 and out the outlets 150. Turning the thumbscrew 134 clockwise moves the rail 132 inward to contact the upper wall 154 of the inner channel 136, conducting Megasonic energy to the inner channel 136; thereby, energizing slurry delivered to the wafer surface 142 during the polish cycle and/or rinse fluid delivered following the polish cycle.

The delivery section 124 is beveled and the outlets 150 are located on the beveled surface 156 to direct the cleaning fluid to strike the pad surface 140 at an angle. The selected angle may vary depending upon pad type, rotational speeds, or other process considerations. However, the pad cleaning fluid's angle of incidence should be other than 90 degrees so that fluid striking the surface 140 undercuts the waste material to the pad surface. Thus, the cleaning fluid lifts slurry and/or residual particles from the surface 140, washing them away, preventing them from being embedded into the pad 140.

Also, if the outlets are slits to provide a fanned spray, the slits should be partially rotated (between 20–70 degrees) with respect to the plane of the pad surface 140. Preferably, slits should be partially rotated 45 degrees counterclockwise for a clockwise pad rotation. This slit rotation provides, in effect, a sweeping motion of the pad cleaning fluid across the pad surface 140 from carrier center to pad edge. Thus, the preferred assembly forces glazed slurry and/or residual particles away from the carrier and into a catch basin (not shown) around the pad 158. The beveled surface 156 extends down to form a ridge 160 which contains polishing slurry delivered from outlets 146 within a polishing perimeter and prevents pad washing fluid from outlets 150 or loosened debris from backwashing into the polishing perimeter.

The selected conditioning fluid may be DI water, slurry (as an abrasive), or any other fluid (whether liquid or gas) suitable for cleansing the pad surface 140 of glazed slurry and/or residual particles. Optionally, fluid flow may be pulsed. Also, two different fluids may be employed, a different fluid in each row of outlets 150.

Thus, the present invention provides an independent sub-environment for the wafer/pad interface (i.e., within the polishing perimeter) during the polish process. By integrating the conditioning/rinsing mechanisms, the slurry delivery mechanism and the carrier body into a single assembly, the present invention avoids the prior art lag time between pad conditioning/cleaning and resuming polishing. In effect, the present invention provides a closed polishing system; whereby, the wafer is completely isolated from the outside (tool) environment, an environment that, due to the very nature of CMP, is normally contaminated with harmful foreign material.

While the invention has been described in terms of preferred embodiments, those skilled in the art will recognize that the invention can be practiced with modification within the spirit and scope of the appended claims.

We claim:

1. An assembly for cleaning a polishing pad during Chem-Mech polishing, said assembly comprising:

a plurality of legs; and a skirt rotatably attached to each said leg, said skirt distributing and delivering conditioning fluid to a pad while said pad is being used to chem mech polish a wafer, said conditioning fluid conditioning the polishing surface of said pad.

2. The assembly of claim 1 wherein each said leg includes at least one fluid delivery channel providing conditioning fluid to said skirt.

3. The assembly of claim 1 wherein each said skirt is attached to one of said legs with a hinge.

4. The assembly of claim 1 wherein the skirt comprises:

a distribution section rotatably coupled to one said leg;

a mid-section adjacent to said distribution section; and a delivery section adjacent to said mid-section and delivering said fluid to said pad.

5. The assembly of claim 4 wherein the skirt is arc-shaped and the distribution section contains a plurality of channels distributing fluid the entire length of said skirt.

6. The assembly of claim 5 wherein the mid-section includes a plurality of vias passing fluid from said distribution section to said delivery section.

7. The assembly of claim 6 wherein the delivery section includes a plurality of outlets delivering conditioning fluid from said vias to said pad.

8. The assembly of claim 6 wherein the mid-section includes at least one transducer energizing conditioning fluid delivered to said pad.

9. The assembly of claim 8 wherein the mid-section further comprises:

a rail of acoustically conductive material coupled to each said at least one transducer; and at least one positional screw setting the radial position of said rail.

10. The assembly of claim 9 wherein an outer channel is formed when said delivery section is adjacent said mid-section, said outer channel providing a fluid path from at least one of said plurality of vias to at least one of said plurality of outlets, a portion of said outer channel's wall being said rail.

11. The assembly of claim 10 wherein an inner channel is formed when said delivery section is adjacent to said mid-section.

12. The assembly of claim 11 wherein said inner channel passes slurry through at least one of said plurality of outlets to said pad.

13. An assembly for cleaning a polishing pad during Chem-Mech polishing, said assembly comprising:

a skirt positionable about a periphery of a wafer carrier;

a conditioning fluid delivery mechanism in said skirt for delivering conditioning fluid to a polishing surface of a polishing pad during chem-mech polishing; and a connector for connecting said skirt to said wafer carrier.

14. The assembly of claim 13 wherein said skirt is segmented into several skirt members, and wherein said connector includes a connection to each of said skirt members.

15. The assembly of claim 14 further comprising a hinge section in each connection, said hinge section allowing each said skirt section to be rotatably moved away from said wafer carrier.

16. The assembly of claim 15 wherein each said skirt section comprises:

a distribution section coupled to said hinge section;

a mid-section adjacent to said distribution section; and a delivery section adjacent to said mid-section and delivering said fluid to said polishing pad.

17. An assembly for Chem-Mech polishing, said assembly comprising:

a wafer carrier;

a metal spider attachable at its center to a wafer carrier and having four legs extending from said center;

a hinge at an end of each said leg; and an arc shaped skirt attached to each said hinge, each said skirt comprising:

a distribution section receiving fluid from said leg and distributing said received fluid along the length of said skirt through a plurality of distribution channels;

a mid-section having a plurality of vias, each of said plurality of distribution channels being connected to at least one of said plurality of vias; and a delivery section receiving fluid from said distribution section through said vias and delivering said received fluid to said pad through a plurality of outlets when said pad is polishing a wafer.

18. The assembly of claim 17 wherein the mid-section further comprises:

at least one transducer energizing conditioning fluid delivered to said pad;

a rail of acoustically conductive material coupled to each said at least one transducer; and at least one positional screw setting the radial position of said rail.

19. The assembly of claim 18 wherein said plurality of outlets includes a plurality of slit shaped outlets.

20. The assembly of claim 19 wherein the skirt further comprises:

an outer channel being formed at the interface between said delivery section and said mid-section, said outer channel providing a fluid path from at least one of said plurality of vias to said plurality of slit shaped outlets, a portion of said outer channel's wall being said rail;

an inner channel being formed at the interface between said delivery section and said mid-section, said inner channel passing slurry through at least one of said plurality of outlets to said pad.

* * * * *